US006309512B1

(12) United States Patent
Bengtsson et al.

(10) Patent No.: US 6,309,512 B1
(45) **Date of Patent: *Oct. 30, 2001**

(54) DEVICE FOR IMPULSE-PRESSING A WEB

(75) Inventors: Jan Martin Bengtsson, Karlstad; Erik Brox, Forshaga; Leif Erik Helgesson, Karlstad; Kjell Sune Evald Jansson, Forshaga; Anna Malin Katarina Kilian, Karlstad; Jan Wilhelm Nicander, Karlstad; Nils-Erik Säfman, Karlstad; Kenth Roger Törnqvist, Karlstad, all of (SE)

(73) Assignee: Valmet Karlstad AB, Karlstad (SE)

( * ) Notice: Subject to any disclaimer, the term of this patent is extended or adjusted under 35 U.S.C. 154(b) by 0 days.

This patent is subject to a terminal disclaimer.

(21) Appl. No.: 09/401,208

(22) Filed: Sep. 22, 1999

(30) Foreign Application Priority Data

Sep. 22, 1998 (SE) ..... 9803201

(51) Int. Cl.[7] ..... D21F 3/02

(52) U.S. Cl. ..... 162/358.5; 162/358.3; 162/361; 100/172; 492/46

(58) Field of Search ..... 162/206, 358.1, 162/358.3, 358.5, 359.1, 361; 100/172, 327, 330; 492/46, 15, 20

(56) References Cited

U.S. PATENT DOCUMENTS 3,678,846 * 7/1972 Bjorkegren ..... 100/155 R
3,991,669 * 11/1976 Cumbers ..... 100/162
4,324,613 4/1982 Wahren .
4,510,823 * 4/1985 Leech ..... 100/172
4,738,752 4/1988 Busker et al. .
5,082,533 * 1/1992 Pulkowski et al. ..... 162/358.5
5,302,252 * 4/1994 Gotz ..... 162/358.3
5,711,854 * 1/1998 Schiel et al. ..... 162/358.5
6,012,234 * 1/2000 Schiel ..... 34/119

FOREIGN PATENT DOCUMENTS

84/02726 * 7/1984 (WO) ..... 162/358.3
WO 95/10659 4/1995 (WO) .

* cited by examiner

*Primary Examiner*—Karen M. Hastings
(74) *Attorney, Agent, or Firm*—Alston & Bird LLP

(57) ABSTRACT

A press section in a machine for manufacturing a web of fibrous material, comprising a shoe press with extended press nip, the shoe press having a counter roll with a cylindrical press body; a press shoe with a concave surface for cooperation with the press body; an impermeable belt running through the press nip in sliding contact with the press shoe; a clothing running in a loop around guide rolls and through the press nip in contact with the web, and being capable of receiving and carrying liquid along with it; a movable heat transfer means for continuous transfer of heat to the web in the extended press nip; and a heat source for heating the heat transfer means. According to the invention the counter roll comprises a sleeve that forms the heat transfer means and encloses the press body. The invention also relates to a shoe press, a press section with a roll press, and treatment sections with roll and shoe calendars with sleeves of the type described.

18 Claims, 8 Drawing Sheets

Fig. 7
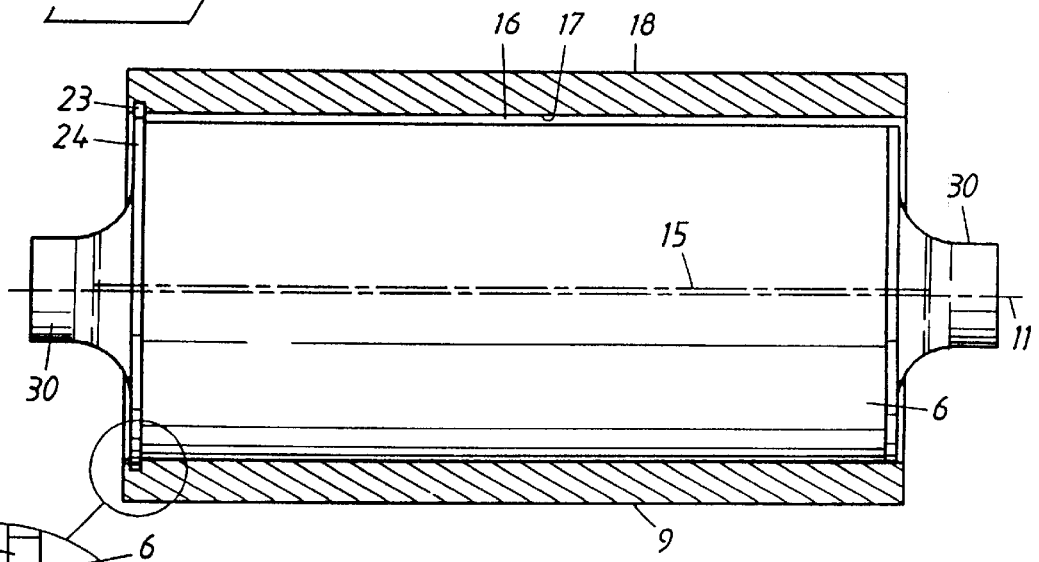
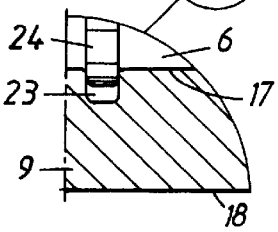
Fig. 7a
Fig. 8
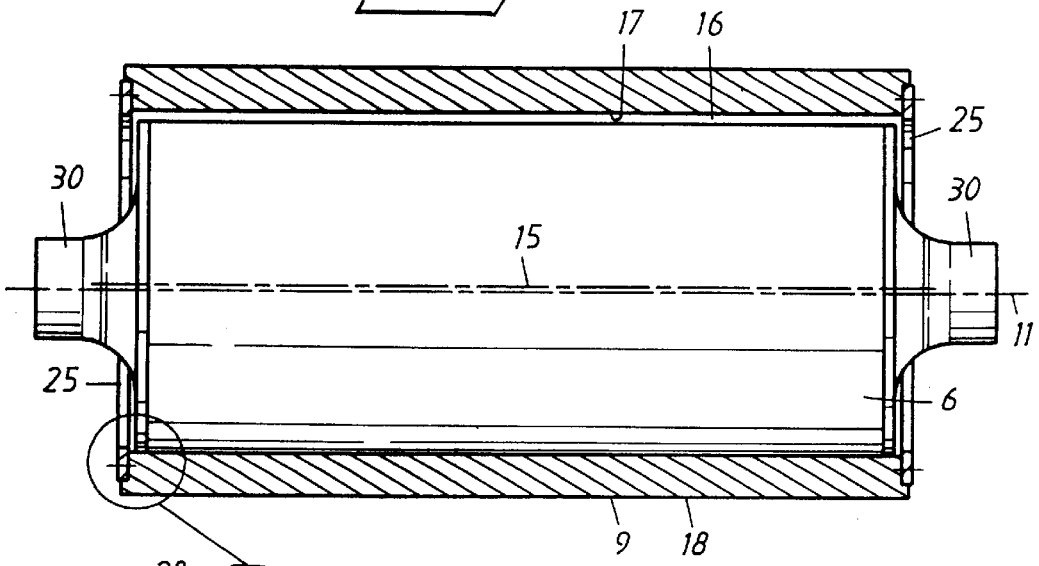
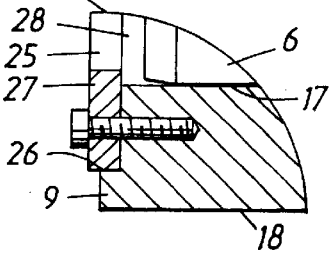
Fig. 8a

Fig. 9a
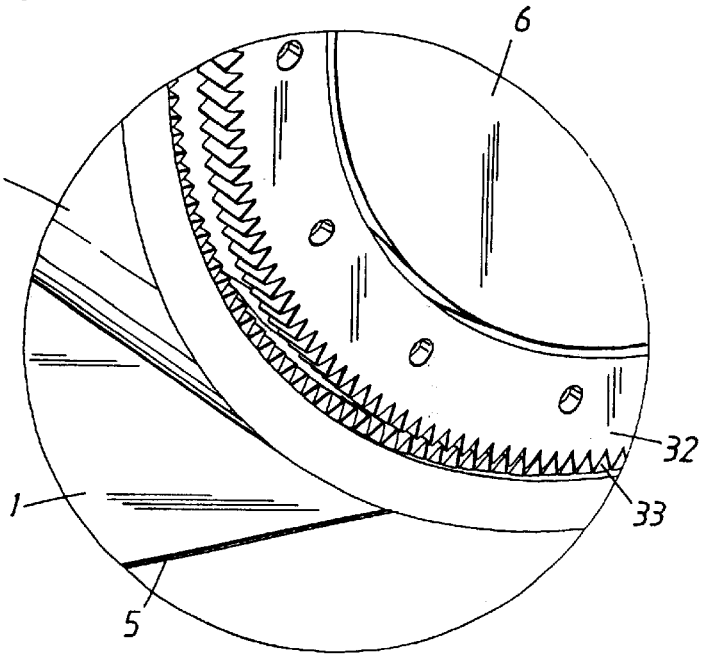
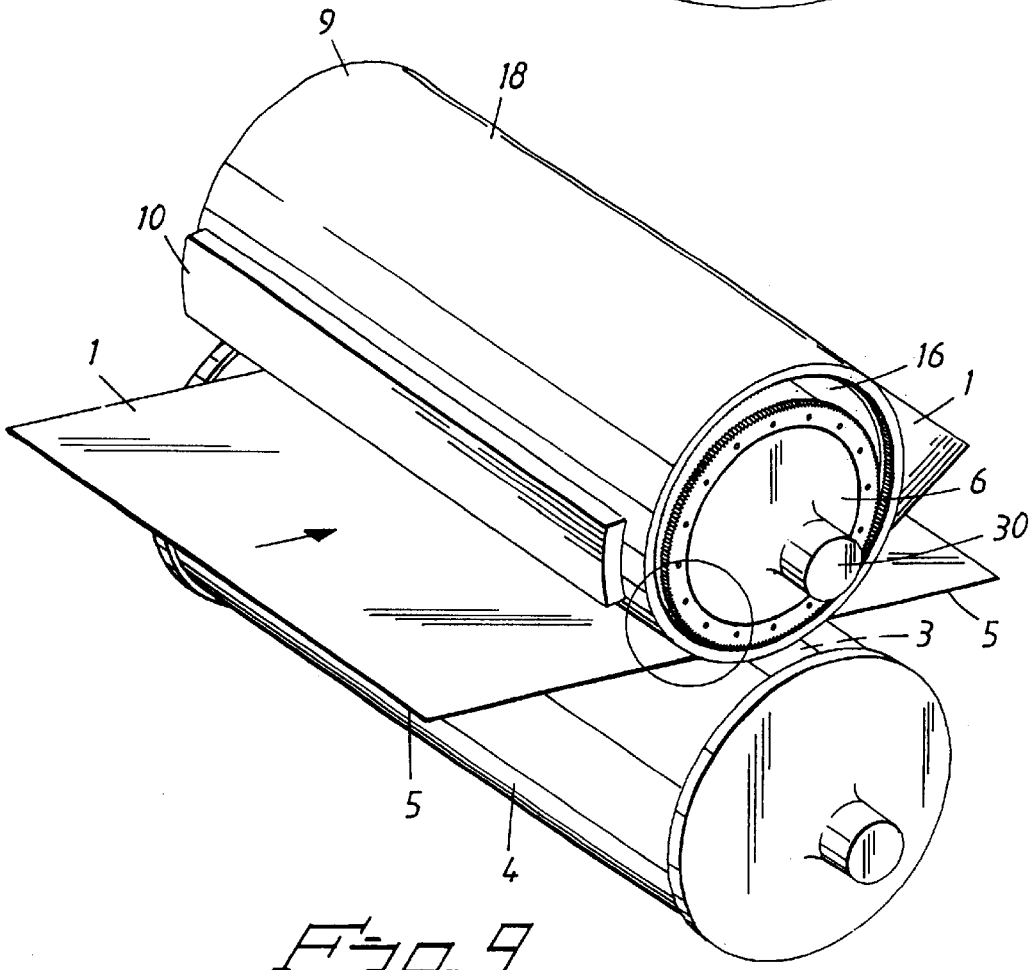
Fig. 9

Fig.10a
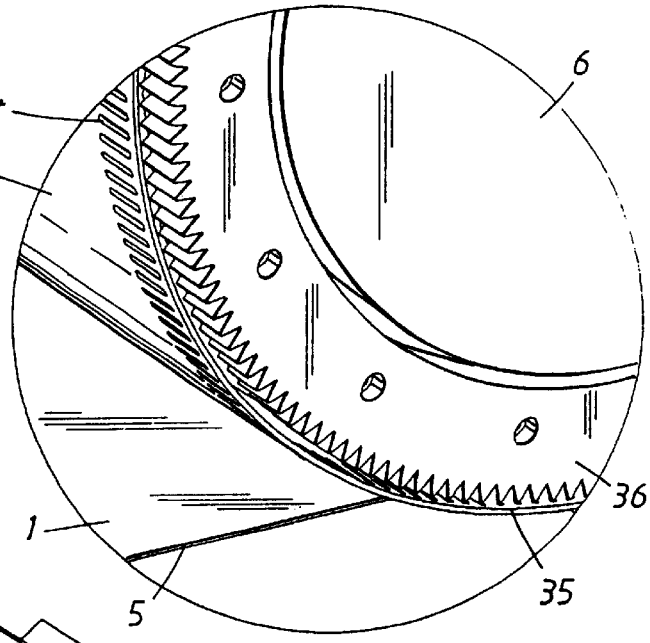
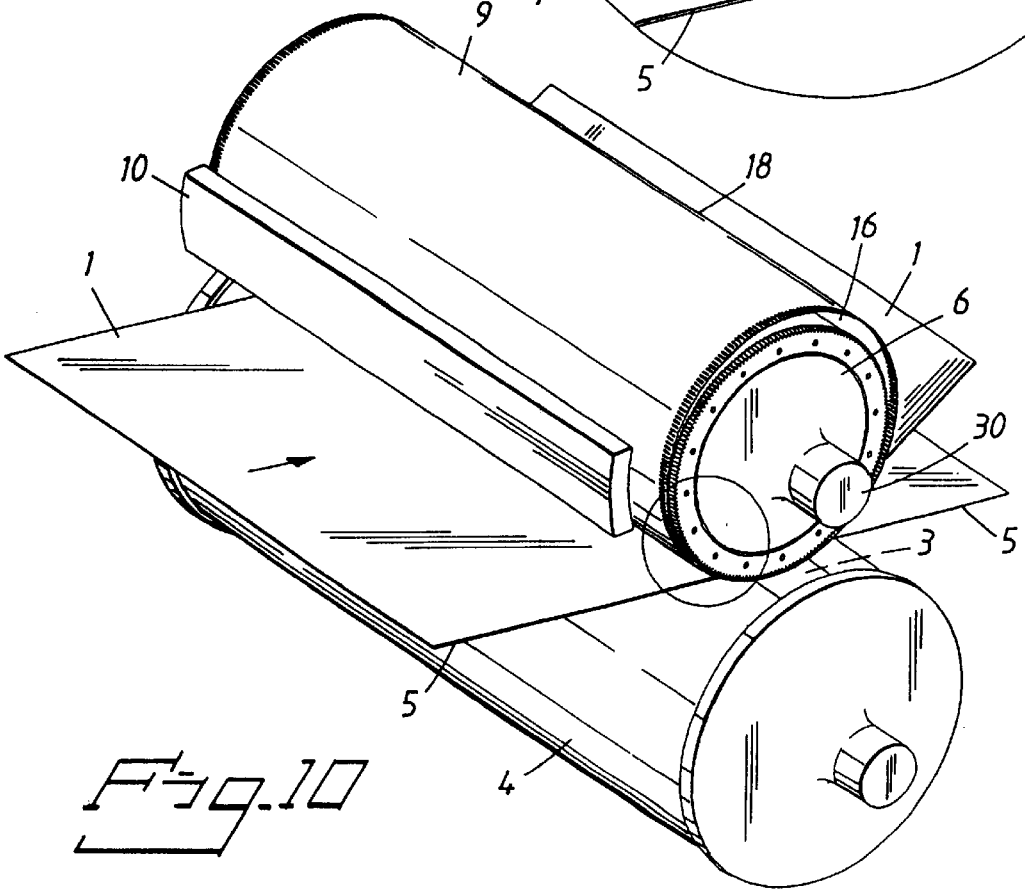
Fig.10

DEVICE FOR IMPULSE-PRESSING A WEB

FIELD OF THE INVENTION

The present invention relates to pressing devices for removing water from a web of fibrous material in a paper-making or board-making machine. The invention relates more particularly to impulse-pressing devices in which the web is passed through a nip and the web in the nip is rapidly heated such that high pressure and high temperature are simultaneously produced in the web.

BACKGROUND OF THE INVENTION

Pressing a wet paper web in a press section at elevated temperature has been shown to result in a number of beneficial effects. The technology, known as impulse technology, impulse drying or impulse pressing, was first described in SE-7803672-0, corresponding to U.S. Pat. No. 4,324,613, which discloses a roll press. The top pressure utilized in the process described therein lies within the range of 3–8 MPa and the surface temperatures between 150° C. and 350° C. for a cylinder in a press nip of conventional type. The dwell time during which a given region of the web is within the nip in such a roll press, however, is only a few milliseconds, which is too short a time to be able to take full advantage of the favorable effects of pressing at high temperature. It has therefore been proposed subsequently to utilize impulse drying in a heated shoe press in which the nip is extended so that the dwell time for the heat treatment is greatly extended.

In impulse drying, high temperature and high pressure are combined for a brief period of time in order to give extremely high heat flows to the web. The envelope surface of a steel or cast iron roll has maximum heat flow in the range of 2–8 $MW/m^2$, which results in extremely high dewatering speeds. The mechanism forming the basis of these high dewatering speeds, with consequent high dry solids content, has not yet been fully discerned. One theory presented is that, through its expansion, the steam which is developed in the vicinity of the hot surface of the heat-transfer element nearest the fibrous web helps to displace water remaining in the fibrous web into the felt that is in contact with the fibrous web. Another theory is that high dry solids content is achieved by virtue of the reduced viscosity of the water caused by the high temperature, in combination with water at high temperature (>100° C.) being quickly vaporized when the web leaves the nip and the pressure thus drops to atmospheric pressure.

According to the '613 patent, a burner supplies heat to one roll in a press with two rotating rolls. The heat is supplied to the envelope surface of the roll immediately before the press nip. The patent specification states that the roll may have a surface layer with low thermal conductivity, thereby enabling it to maintain a high temperature.

U.S. Pat. No. 4,738,752 describes an extended, heated press nip where the fibrous web encounters a hot surface formed by a rotatable press roll or a metal belt passing in a loop around a plurality of guide rolls. The press roll or belt is heated by a heat source. The press roll may have a first coaxial layer and a second coaxial layer extending around the first layer and having a coefficient of thermal conductivity that is greater than that of the first layer. The first layer may consist of ceramic, whereas the second, outer layer consists of metal and has a thickness of 0.0127–1.27 cm. The layers are in intimate contact with each other and, together, form a unitary body.

When a roll of the described known types is heated from the outside, the outer layer will be hotter than the layer or layers disposed inside the outer layer which is rigidly joined to the next inner layer. The outer layer will therefore expand more than the inner layer, thereby causing stresses to arise between the two layers. Even if the roll is homogenous, the same differences will arise in expansion and stresses between the outer and inner parts. To reduce the risk of damage in the roll as a result of such stress differences, the initial heating of the roll must take place slowly. Another problem is that it is difficult to maintain the geometric shape of the roll across the machine direction, because of difficulties in maintaining the same temperature along the envelope surface of the roll and at the end walls. Considerable stresses also arise between these construction elements since they cannot expand freely independently of each other, and the envelope surface can become bowed outwardly or inwardly across the machine direction. Since the inner layer or part of the roll will also absorb some of the thermal energy supplied, the heating costs will be high.

One drawback with the use of a metal belt as a heat-transfer means is that it must be arranged in a loop with at least two rolls, thus constituting a space-consuming configuration. To allow the surface of the belt to be cleaned with a doctor, a counter roll must be arranged inside the loop of the belt in front of the doctor. Another drawback is that the belt cannot usually be coated with layers to achieve certain release properties and certain thermal conductivity properties.

A number of the problems discussed above exist also in roll presses and calendars that supply heat to the web.

SUMMARY OF THE INVENTION

The present invention seeks to overcome at least some of the drawbacks noted above, by providing a pressing device and associated method in which a heat transfer element that heats and presses the web is allowed to freely expand in all directions upon heating so that deleterious stresses tend not to develop in the heat transfer element. In accordance with a preferred embodiment of the invention, a pressing device comprises first and second press members defining a nip therebetween through which the web is passed. The first press member includes a rotating component defining a rotating surface for exerting pressure on the web. The second press member comprises a generally cylindrical press body that rotates about a central longitudinal axis thereof, and a generally tubular sleeve that surrounds the press body. The press body urges the sleeve toward the first press member. In preferred embodiments of the invention, the press body causes the sleeve to rotate with the press body, although alternatively the sleeve can be rotated by a separate driving mechanism. The sleeve is movably connected to the press body such that the sleeve is free to expand in all directions relative to the press body. The pressing device further includes a heat source arranged to continuously heat the sleeve such that heat is transferred from the sleeve to the web.

Advantageously, the sleeve's inner surface is radially spaced from the press body's outer surface over the majority of the circumference of the sleeve, the two surfaces coming into contact in the vicinity of the press nip. The sleeve may be substantially rigid or flexible. The second press member preferably includes one or more stop elements arranged at one end thereof for axially restraining a corresponding end of the sleeve, while still allowing the sleeve to expand axially as well as radially and circumferentially. Various types of stop elements are disclosed. As an alternative to the stop elements, the press body can be cambered over its length (i.e., bowed outwardly such that its outer surface is convex in the cross-machine direction), and the inner surface of the sleeve can be correspondingly cambered (i.e., concave in the cross-machine direction). The cambered surfaces tend to restrain the sleeve to reside in its desired location, while still permitting the sleeve to freely exand in all directions.

The sleeve advantageously can have a plurality of circumferential grooves formed in its inner surface facing the press body, the grooves being spaced axially along the length of the sleeve. The grooves reduce the contact area between the sleeve and the press body, thereby reducing heat transfer from the sleeve to the press body.

The sleeve can be driven to rotate by frictional contact between the press body and the inner surface of the sleeve. Alternatively, the press body and sleeve can have elements that meshingly engage each other. For example, in one embodiment of the invention, the press body has tooth elements formed about its circumference, and the sleeve's inner surface has corresponding tooth elements that mesh with those of the press body. Alternatively, the sleeve can define slots for receiving the tooth elements of the press body.

The sleeve can be composed of two or more layers of different materials. For example, an outer surface of the sleeve can be formed by a layer of material having desirable release properties, thermal conductivity properties, wear-resistant properties, and/or corrosion-resistance properties. One layer of the sleeve can comprise a form-stable layer imparting rigidity to the sleeve. The outer surface of the press body, and/or the inner surface of the sleeve, can be formed by a thermally insulating material for reducing heat transfer between the press body and the sleeve.

The pressing device can comprise either a shoe press, a roll press, a shoe calender, or a roll calender. The shoe and roll presses are used in conjunction with a clothing that is passed through the nip in contact with the web. The invention also provides a press section for a paper-making machine, comprising a pair of the pressing devices arranged in tandem for sequentially pressing the web. A first of the pressing devices is arranged such that the sleeve contacts one side of the web. The other pressing device is inverted relative to the first pressing device such that the sleeve contacts the other side of the web.

BRIEF DESCRIPTION OF THE DRAWINGS

The invention will be described in more detail with reference to the drawings.

FIGS. 7 and 7*a* show a counter roll with a rigid sleeve in accordance with a fifth embodiment of the invention.

FIGS. 8 and 8*a* show a counter roll with a rigid sleeve in accordance with a sixth embodiment of the invention.

FIG. 9 shows a shoe press similar to the one in FIG. 1 but with a rigid sleeve in accordance with a seventh embodiment for geared operation by means of cooperating toothed elements on both sleeve and press body.

FIG. 9*a* is a detail enlargement of a portion of FIG. 9.

FIG. 10 shows a shoe press similar to the one in FIG. 9 but with a flexible sleeve in accordance with a further embodiment for geared operation by means of cooperating toothed elements.

FIG. 10*a* is a detail enlargement of a portion of FIG. 10.

DETAILED DESCRIPTION OF THE INVENTION

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Figure 1:
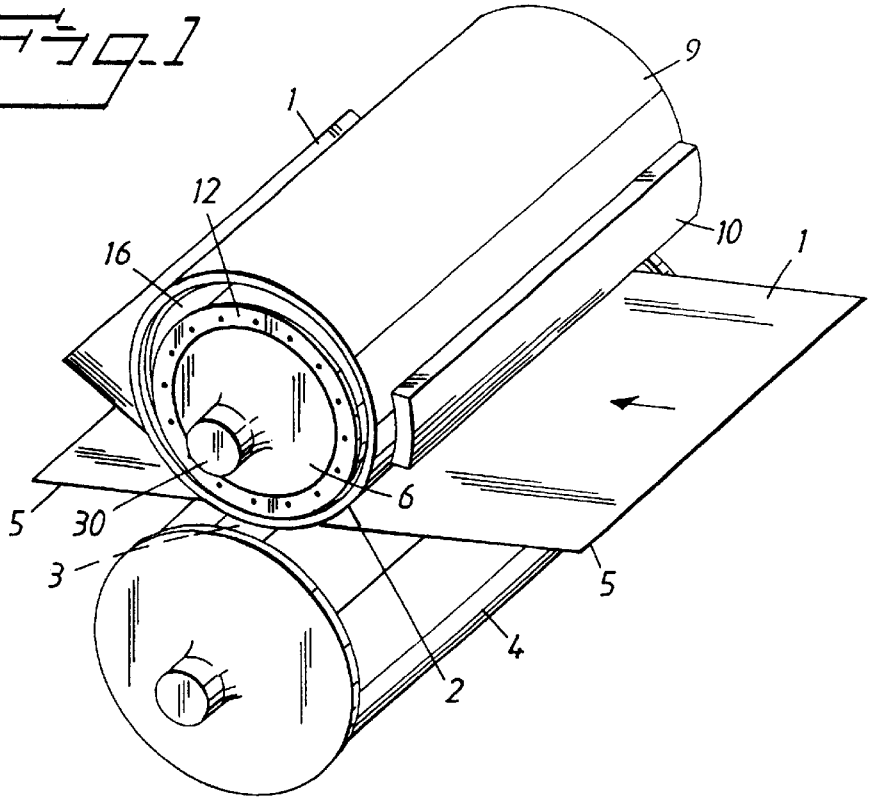
FIG. 1 is a view in perspective of a shoe press in accordance with one embodiment of the invention, the counter roll of which has a rigid sleeve.
Figure 2:
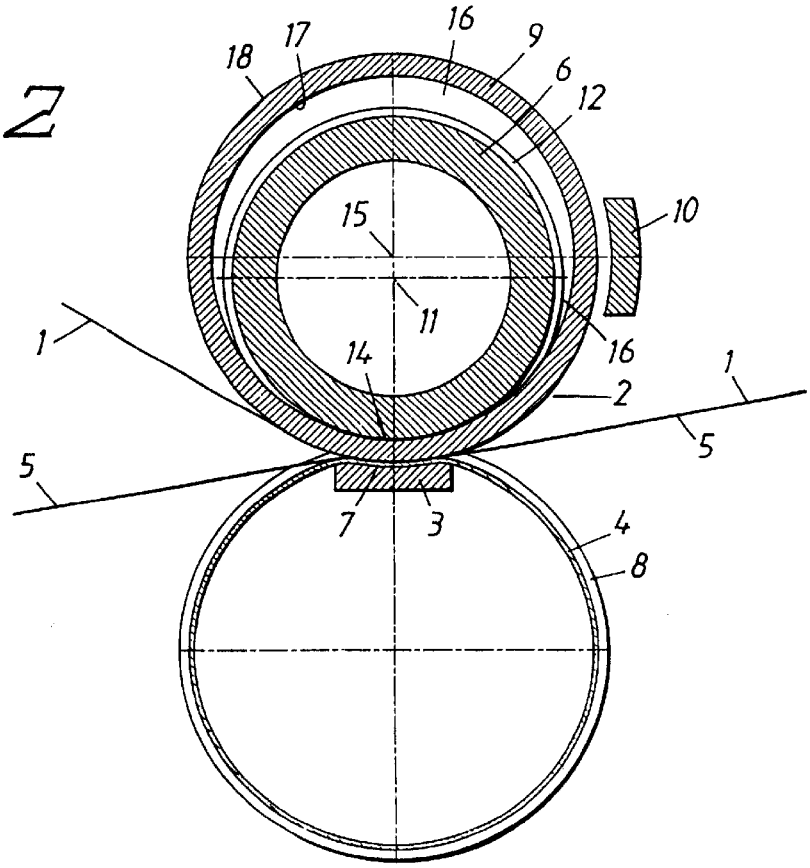
FIG. 2 is a section through the shoe press in accordance with FIG. 1.

FIGS. 1 and 2 schematically depict parts of a shoe press with an extended press nip, included in the press section of a machine for manufacturing a continuous web 1 of cellulosic fibrous material, for instance. The invention is particularly applicable, although not exclusively, to paper or board machines. The paper machine may be designed for manufacturing soft paper or printing paper, e.g. newspaper, or any other grade of paper. The shoe press comprises a rotatably journalled counter roll 2, a press shoe 3, an impermeable, flexible belt 4 and a clothing 5, which is in direct contact with the web 1 and is capable of receiving water in liquid and gaseous form from the web and carrying it out of the press nip. The counter roll 2 comprises a stable cylindrical press body 6 having shaft journals 30 for rotary journalling of the counter roll in bearing housings (not shown). The press body 6 rotates about an axis of rotation 11 and has an envelop surface with circular cross section. The press shoe 3 has a concave surface 7 for pressure-generating cooperation with the corresponding convex press body 6 so as to form an extended press nip. The belt 4 runs through the press nip in sliding contact with the concave surface 7 of the press shoe. In the embodiment shown, the shoe press is provided with a shoe press roll comprising the press shoe 3 and belt 4 which is rigidly mounted at rotatable peripheral end portions 8. Alternatively, the flexible belt may run in a loop around a plurality of rolls and the press shoe may be disposed within the loop.

The clothing 5 of the shoe press runs in a loop around a plurality of guide rolls (not shown) and through the extended press nip. The web 1 is carried to nip by the clothing 5 and is separated from the clothing 5 after the press nip. Alternatively the web can run in an open draw before the press nip. The clothing 5 usually consists of a press felt, but a permeable belt with through openings and possible recesses disposed or extending therebetween may be used, or an impermeable belt with recesses of suitable depth, shape and extension. Such recesses are situated on the side of the clothing facing towards the web 1 and are arranged to receive liquid from the web and carry the liquid out of the press nip. The openings and recesses also give the web a structured appearance which increases the bulk of the web. Instead of a permeable belt or impermeable belt, an open wire or closed wire which has a sealing layer facing away from the web may be used.

The shoe press also comprises a heat transfer element 9 for continuous transfer of heat to the web 1 when the latter passes through the extended press nip, and a heat source 10 which is arranged at a predetermined point before the press nip, e.g. about 30°–330° of arc, and more preferably about 30°–120° of arc, before the press nip for continuous heating of the heat transfer element 9 at start-up to a desired operating temperature and during operation to maintain this operating temperature. The heat source may be fixed or movable, e.g. oscillating.

According to the present invention, the counter roll 2 comprises a sleeve forming the heat transfer element 9 and enclosing at least the axial part of the cylindrical press body 6 that is active in the press nip. The sleeve 9 is mounted such that it is permitted to expand freely in relation to the press body 6 during heating before the press nip, without unfavorable stresses arising in the sleeve. The sleeve 9 has an inner side 17 and an outer side 18, the inner side 17 being arranged to be brought into contact with the press body 6 within the zone of the press nip. The sleeve 9 consequently lacks any mechanical or adhering connection or other such permanent, fixing connection which would prevent such free expansion of the sleeve 9 axially and radially in relation to the cylindrical press body 6 outside the press nip where heating occurs, and which would give rise to unfavorable stresses in the sleeve.

Figure 3:
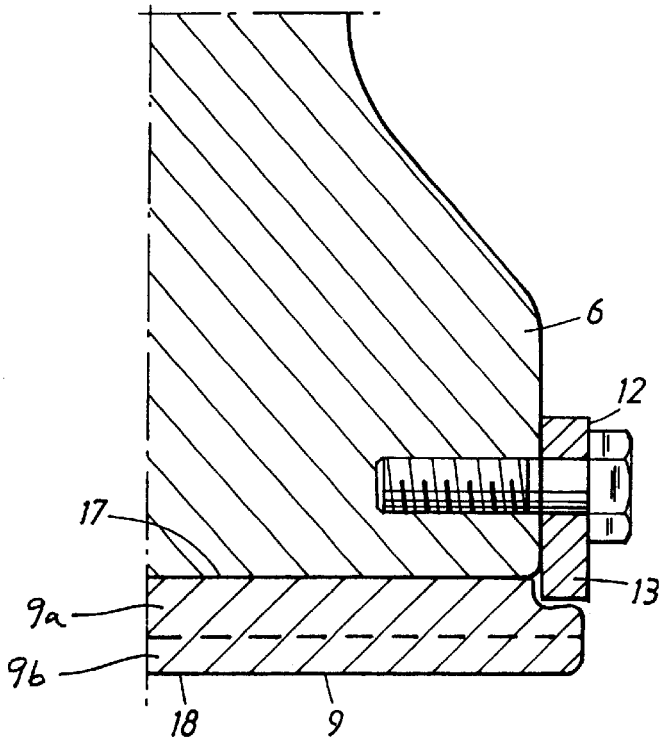
FIG. 3 is a section through a part of the counter roll and its sleeve in accordance with FIG. 1.

Advantageously, stop elements in the form of flat circular rings 12 are fitted at the end surfaces of the cylindrical press body 6. These rings 12 have a somewhat larger outer diameter than that of the cylindrical press body 6, in order to provide axial end stops 13 for the sleeve 9, as can be seen in FIG. 3. Even during operation the sleeve 9, which is axially expanding due to heating, is free from contact with one or both of these end stops 13 in order to avoid axial stresses in the sleeve so that the straightness of the sleeve can be ensured.

The sleeve 9 is thus completely free from permanent, locking connections in all directions so that it is permitted to expand free from stress both axially and radially in relation to the cylindrical press body 6 during heating. During operation the press body 6 is arranged to press the sleeve 9 firmly at a contact point 14 within the press nip upon pressure-generating cooperation of the press shoe 3 with the press body 6 to form a sufficient friction force at the contact point 14 between opposing surfaces of the press body 6 and the sleeve 9 so that the sleeve 9 is forced to rotate by the press body 6 at the same speed as the latter at said contact point.

The sleeve 9 may be homogenous, i.e. made of the same piece of material all the way through without layers. Alternatively, as depicted in FIG. 3, the sleeve 9 may consist of two or more coherent layers 9*a, b* of different materials, at least one of which acts as at least carrier for the other layer(s).

The sleeve 9 may be in the form of a rigid, form-stable sleeve or a flexible sleeve, which is thus not form-stable.

In FIGS. 1–3, the sleeve 9 is illustrated schematically as a cylindrical, rigid, form-stable sleeve with an outer side 18 having constant, circular cross section and constituting the envelope surface of the rigid sleeve, and with an inner side 17 having a constant, circular cross section and being coaxial with the envelope surface 18. The diameter of the rigid sleeve 9, however, is shown as greatly exaggerated in relation to that of the press body 6. The sleeve 9 shown in FIGS. 1–3 thus has constant wall thickness, measured between the inner side 17 and the outer side 18, over the axial length of the sleeve. The wall thickness of the sleeve 9 is selected depending on each specific use, with varying desires of properties of the sleeve. The wall thickness of the sleeve 9 in the embodiment of the invention shown in FIGS. 1–3 is sufficiently large to ensure that the sleeve is rigid and form-stable, i.e., is at least self-supporting so that, when resting on a flat support, it retains its radius all around and does not collapse to a non-circular form. It should preferably be so rigid and form-stable that it is not noticeably deformed by normal stresses during assembly and operation. The rigid sleeve 9 has sufficient wall thickness for it not to be subjected to too great stresses in the press nip that may arise as a result of differences in radius between the various construction elements.

During operation the rigid sleeve 9 rotates about its own axis of rotation, i.e. its central axis 15, which is situated eccentrically in relation to the axis of rotation or central axis 11 of the press body 6, the eccentric displacement, i.e. the distance between these axes 11, 15, corresponding to the difference in radii between the outer surface of the press body 6 and the inner surface of the sleeve 9. It will be appreciated that in a starting position, when the press shoe 3 and the counter roll 2 are displaced vertically from each other a distance corresponding to said difference in diameter, the sleeve is suspended on the press body 6 and its central axis 15 is thus situated below the central axis 11 of the press body 6.

The concave surface 7 of the press shoe 3 has a radius adapted to the radius of the rigid cylindrical sleeve 9. The sleeve is so rigid and stable that it acquires a pressing function through influence from the press body, i.e. the pressure from the press body at the contact point with the sleeve is transferred forwards and backwards, seen in the direction of rotation, through the sleeve to the press nip so that the length of the press nip will be approximately the same length as the width of the shoe. A slight deformation will arise in the passing section when the rigid sleeve 9 passes the press shoe 3, as a result of differences between the inner radius of the sleeve and the outer radius of the press body. However, this slight deformation will disappear as soon as the pressure ceases after the press nip, and no damaging stresses occur in the rigid sleeve since it is sufficiently thick to withstand this loading. The rigid sleeve thus still fulfils the property of being "form-stable" as this is defined in this patent application. Alternatively, the wall of the rigid sleeve can be made so thin that the sleeve essentially conforms to the contour of the press body in the region of the nip, provided the material in the wall of the sleeve can withstand this deformation without it becoming a permanent deformation.

Thanks to the free space 16 inside the sleeve 9, only slight amounts of heat will be consumed by the press body. During operation this space 16 containing air is in the shape of a crescent. Transfer of heat from the sleeve 9 to the press body 6 occurs almost entirely within the contact point 14 in the press nip. However, the amounts of heat consumed here are in any case small since the contact surface here constitutes a very small proportion of the circumference and the fact that the heat is transported from one surface to another. The temperature in the hot surface of the sleeve at the beginning of the press nip may generally be within the range of 150° C.–400° C.

Since the rigid cylindrical sleeve 9 remains round during operation, a constant distance between the sleeve 9 and the heater 10 is maintained at constant operating temperature.

Figure 4:
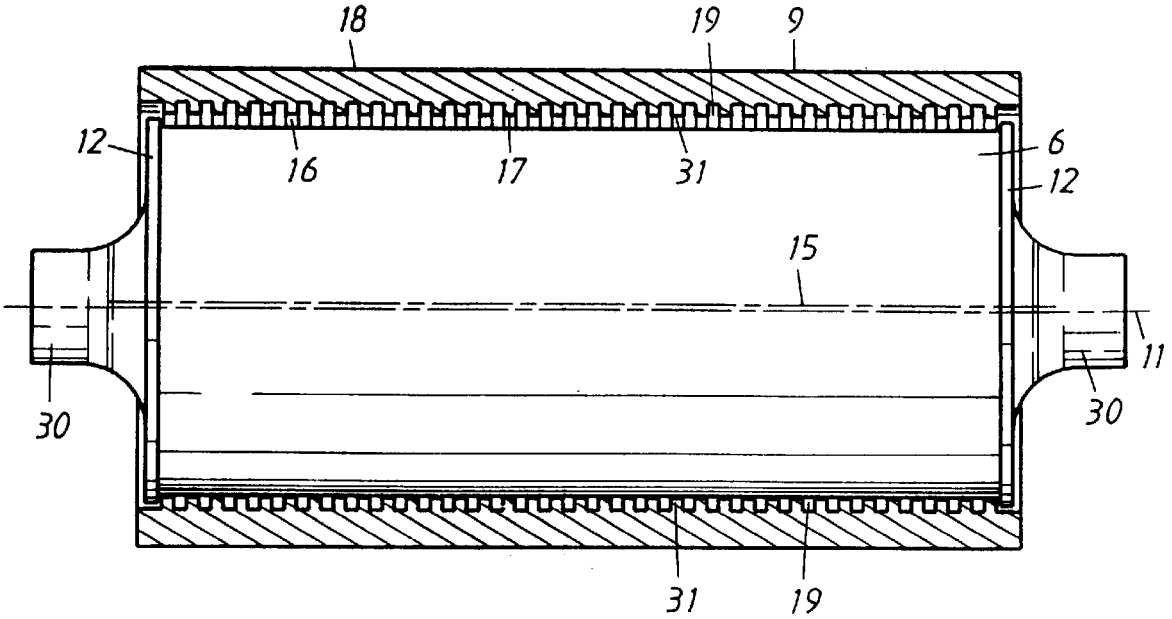
FIG. 4 shows a counter roll with a rigid sleeve in accordance with a second embodiment of the invention.

FIG. 4 shows another embodiment of a rigid sleeve 9, the inner side 17 of which is provided with a plurality of endless grooves 19 which are axially uniformly distributed and extend round the circumference to form corresponding cams 31, the cylindrical surfaces of which form the inner side 17 of the sleeve that determines the wall thickness of the sleeve with such grooves. The grooves 19 result in the contact surface with the press body 6 being decreased by about 50% in the illustrated embodiment, and the amount of heat transferred to the press body is thus also reduced. Such a sleeve provided with grooves is therefore advantageous from the energy aspect and also from the heating aspect during start-up, since the heating takes place more quickly without the press body 6 being negatively affected. The sleeve 9 is retained against the press body by means of rings 12 forming stops, as described in the embodiment according to FIG. 3.

Figure 5:
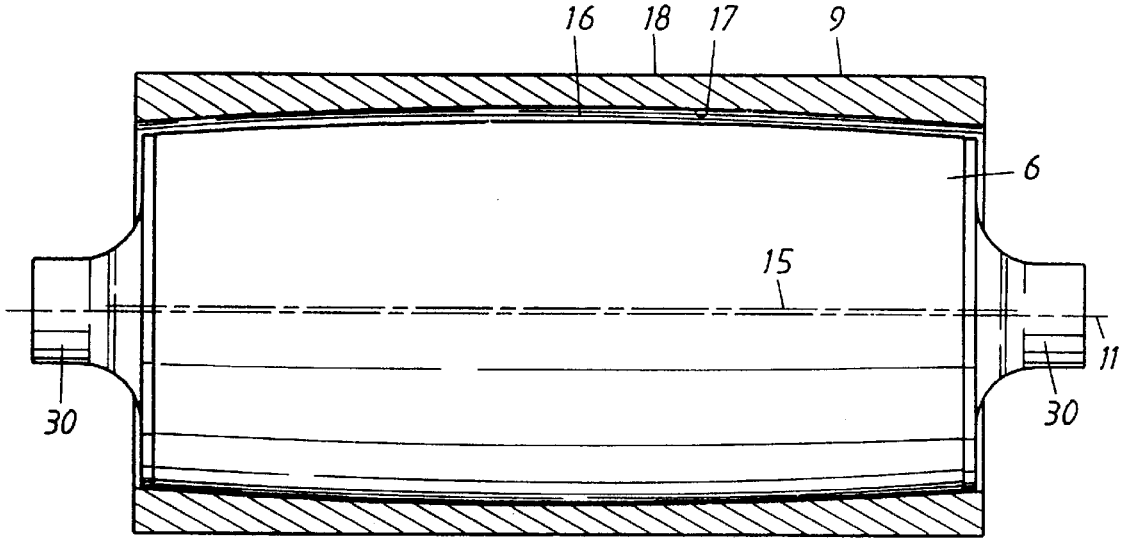
FIG. 5 shows a counter roll with a rigid sleeve in accordance with a third embodiment of the invention in which the counter roll has a cambered press body.

FIG. 5 shows a further embodiment of a rigid sleeve 9 having a cylindrical envelope surface 18 and a cambered inner side 17, the press body 6 having a correspondingly cambered outer side so that the space 16 remains constant along the axial length of the sleeve. Axial guidance of the sleeve is thus achieved in relation to the press body without the need for any mechanical stop. The thickness of the sleeve thus varies over its entire length and is narrowest in the middle. The variations in thickness lie within the thickness values and intervals specified in this patent application.

Figure 6:
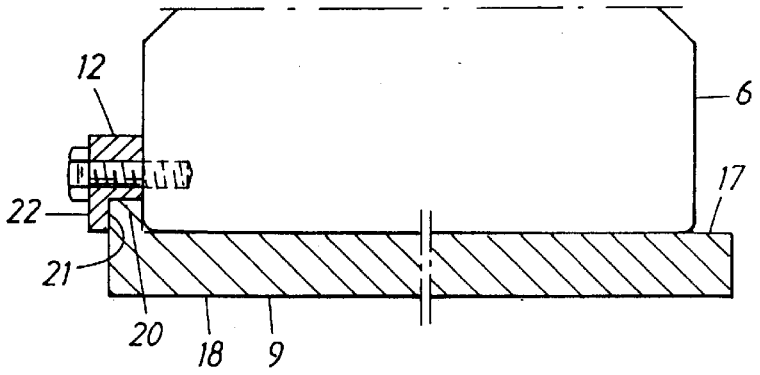
FIG. 6 shows a part of a counter roll with a rigid sleeve in accordance with a fourth embodiment of the invention.

FIG. 6 shows an additional embodiment of a rigid sleeve 9, one end of which is provided with or designed with a radially inwardly directed flange 20. A circular ring 12 is then mounted at one end surface of the press body 6, the ring 12 having a peripheral recess 21 for receipt of the sleeve flange 20 to form an axial, outer stop 22 to retain the sleeve 9 on the press body 6 while still allowing it to expand freely in relation to the press body 6 towards its other end which is entirely free. A small gap exists between the flange 20 and stop 22 or between the flange 20 and press body 6 to allow a movement of the sleeve 9 circumferentially in relation to the press body 6.

FIGS. 7 and 7*a* show a further embodiment of a rigid sleeve the inner side of which is provided with a recess 23 running around the inner side, in which a flat ring 24 is received to function as an axial stop for the sleeve. The ring 24 is rigidly mounted on the press body 6.

FIGS. 8 and 8*a* show an additional embodiment of a rigid sleeve 9, both ends of which carry a flat ring 25 rigidly mounted on the sleeve 9. The ring 25 is suitably inserted into recesses 26 in the ends of the sleeve 9 and has an inner diameter less than the inner diameter of the sleeve so that a stop 27 is obtained to retain the sleeve 9 on the press body 6, the sleeve 9 being somewhat longer than the press body 6 so that a small space 28 is obtained between each stop ring 25 and the opposing end surface of the press body. The rings 25 preferably have the same or substantially the same coefficient of linear thermal expansion as the sleeve 9.

FIGS. 9 and 9*a* show a further embodiment of the press body 6 and rigid sleeve 9 of the counter roll. The press body 6 is provided at its ends with a toothed ring 32 having external teeth, the sleeve 9 being provided on its inner side 17 with a toothed ring 33 having internal teeth in order to obtain a toothed engagement within the area of the press nip. The teeth do not engage with each other after the press nip. The sleeve 9 is thus caused to rotate by means of gear transmission, whereas the sleeves described previously here are driven by means of frictional engagement between the surfaces meeting in the press nip. Alternatively, the toothed rings of the sleeve can be mounted on the end surfaces of the sleeve, in which case the toothed rings of the press body are also mounted on its end surfaces (not shown). According to another alternative (not shown), the sleeve is provided at one end with a toothed ring which is in engagement with tooth elements of an external drive member, in which case a similar drive arrangement is provided at the other end of the sleeve. Like the ring 25 of the sleeve depicted in FIG. 8, the toothed ring 33 has the same or substantially the same coefficient of linear expansion as the sleeve in order to avoid undesired stresses in the sleeve upon heating.

FIGS. 10 and 10*a* show an embodiment of a sleeve 9 which is flexible. The end portions of the flexible sleeve 9 are provided with axial slots 34 to form a circumferential engagement portion 35, with which toothed rings 36 arranged on the press body 6 are brought into engagement within the area of the press nip.

The wall thickness of the rigid sleeve 9 is generally within the interval 5–100 mm, preferably 15–40 mm.

The difference between the internal diameter of the rigid sleeve 9 and the external diameter of the press body 6 is generally within the interval 0.01–100 mm, preferably 0.510–10 mm, measured at room temperature. During operation, when the rigid sleeve is hot, this difference in diameter is naturally considerably greater.

The smaller the wall thickness of the sleeve 9, the quicker a high surface temperature will be obtained without high stresses arising, since the mass to be heated in the radial direction is correspondingly less.

By making the wall of the rigid sleeve 9 sufficiently thick, the surface of the sleeve in contact with the web can be treated as a conventional press roll surface to be cleaned by a doctor, for example.

When the rigid sleeve 9 consists of several layers, one of the layers is a carrier layer (e.g., the layer 9*a* shown in FIG. 3), mainly functioning as a stabilizing carrier, with sufficient wall thickness for the carrier layer to be provided with a surface layer, for instance, having the desired property or properties.

The carrier layer may be provided on its outer side with a surface layer (e.g., the layer 9*b* shown in FIG. 3) of a suitable material to obtain desired release property and/or a desired thermal conductivity of the surface of the cylindrical sleeve 9. A particular thermal conductivity may be desirable in order to control the supply of heat to the web and thus prevent delamination of the web. Delamination is the phenomenon when the web bursts as it leaves the press nip due to the vapor pressure in the web being greater than the forces holding the web together can withstand.

The cylindrical press body 6 may on its outer side be provided with a surface layer of one or more suitable materials in order to increase its resistance to wear and/or resistance to corrosion, and/or to provide insulation so that the amount of heat transferred from the sleeve 9 to the cylindrical press body 6 is further reduced within the press nip. Alternatively or additionally, the sleeve 9 may be provided on its inner side with such a surface layer.

Materials suitable to provide a surface layer with the desired release property and desired thermal conductivity that may be mentioned are aluminum oxide, chromium oxide and zirconium oxide based ceramics. Suitable materials to increase the wear resistance are tungsten and chromium carbides and chromium steel. Suitable materials to increase the corrosion resistance are nickel, chromium, and cobalt based alloys. Suitable insulating materials are zirconium oxide based ceramics. Suitable materials for a homogenous sleeve (i.e., one without layers) and for the carrier layer of a sleeve consisting of at least two layers include nodular iron, cast steel and weldable high-strength structural steel.

A sleeve that is flexible has a wall thickness generally within the interval 0.4–5.0 mm, preferably 0.8–2.3 mm. The difference between the internal circumference of the flexible sleeve and the external circumference of the press body is generally within the interval 0–100 $\pi$mm, preferably 0.1 $\pi$–10$\pi$mm, measured at room temperature. During operation, when the flexible sleeve 9 is hot, this difference in circumference is naturally considerably greater. Since the sleeve 9 is flexible, a cleaning doctor can be arranged at a suitable location so that the sleeve is bent in towards the press body which will therefore function as a counter-support. Like the rigid sleeve, the flexible sleeve may consist of two or more layers.

Any suitable heat source 10 may be used, although an induction heater is currently preferred. Examples of other heat sources are electric heaters, infrared heaters, laser heaters and gas burners.

Figure 2A:
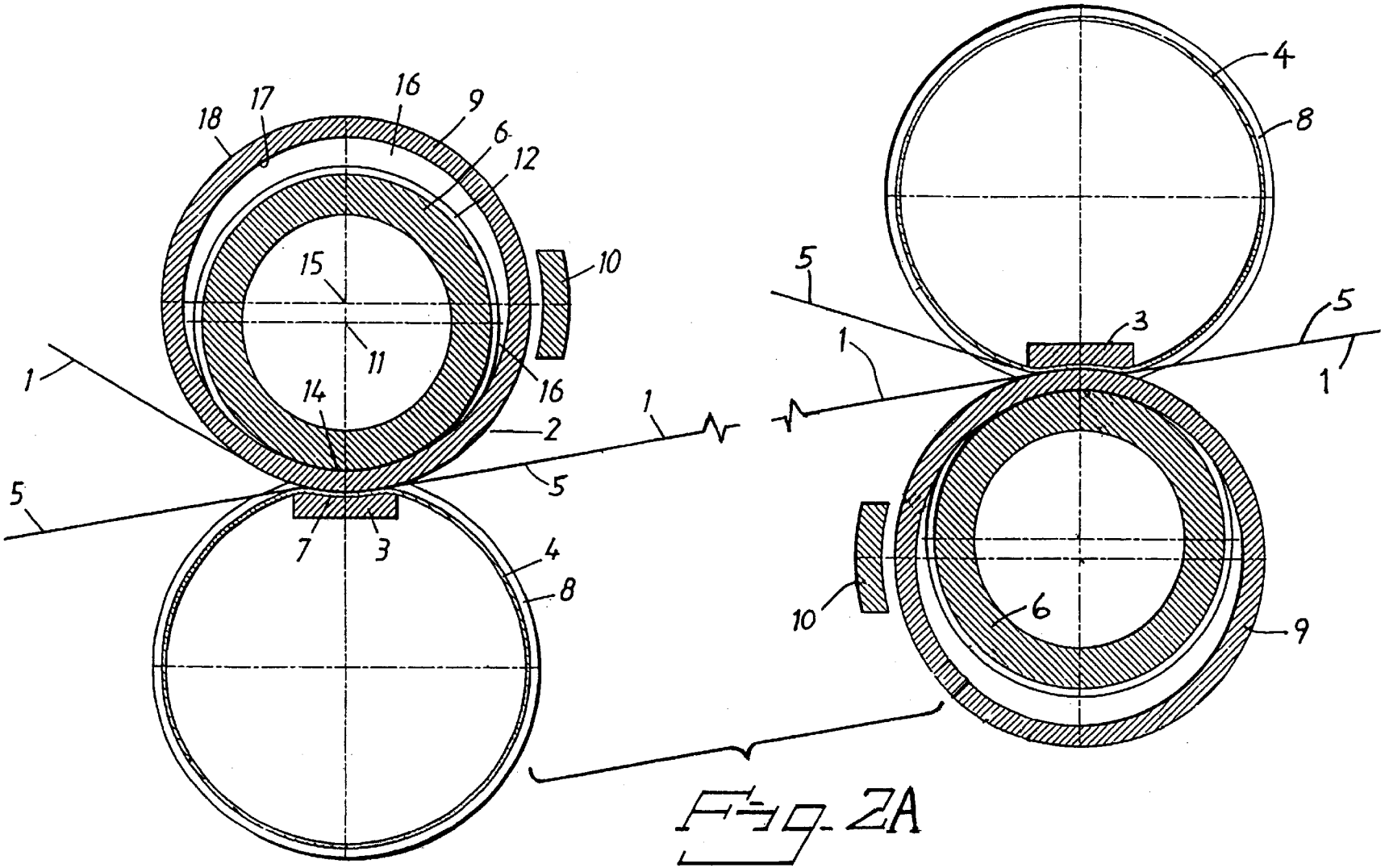
FIG. 2A is a view similar to FIG. 2, showing a pair of tandem shoe presses in inverted orientations relative to each other.

To obtain a symmetrical web the press may suitably comprise a second shoe press provided with a sleeve of the type described or another structure but inverted, so that the sleeve is disposed in under-position in order to transfer heat to the other side of the fibrous web, as shown in FIG. 2A.

The press body of the shoe press may be a solid roll, modified in accordance with the invention, but it is also possible to use a curvature-compensated roll. Since the contact area between the hot sleeve and the shell body of the curvature-compensated roll is small, little heat is transferred to the roll. Sufficient heat can be conducted away with the oil in the roll to maintain a reasonable temperature and thus sufficient viscosity in the oil to achieve satisfactory functioning of the roll.

The temperature of the web may be increased before the press nip by arranging one or more steam boxes in the felt loop and/or close to the free side of the web.

Figure 11:
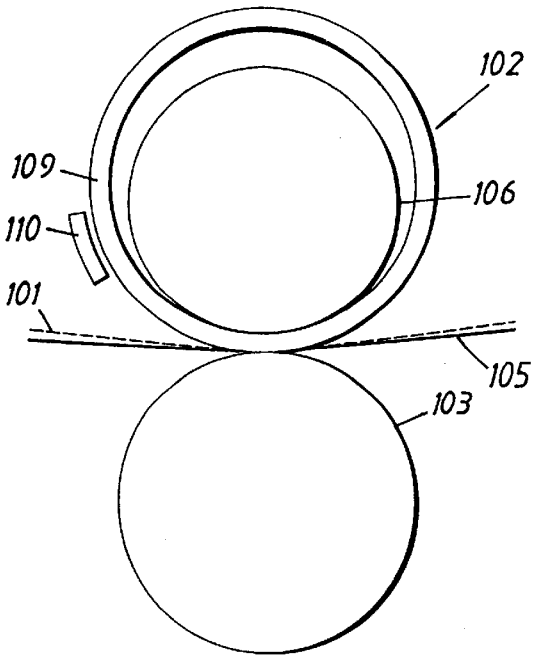
FIG. 11 is an end view of a roll press according to the invention.

FIG. 11 shows schematically parts of a roll press included in the press section of a machine for manufacturing a continuous web 101 of cellulosic fibrous material, for instance. The roll press comprises a first or upper rotatably journalled press roll 102, a second or lower rotatably journalled press roll 103 and a clothing 105, which is in direct contact with the web 101 and is capable of receiving water in liquid and gaseous form from the web, and carrying it out of the press nip that defined by the two press rolls. The upper press roll 102 comprises a stable cylindrical press body 106 having shaft journals (not shown) for rotary journalling of the press roll 102 in bearing housings. As for the rest, the press body 106 is arranged and designed in the same way as described above in connection with the shoe press. Likewise the clothing 105 is arranged and designed in the same way as described above. The roll press has a movable sleeve-formed heat transfer means 109 and a heat source 110 which are arranged and designed in the same way as described above in connection with the shoe press.

Figure 12:
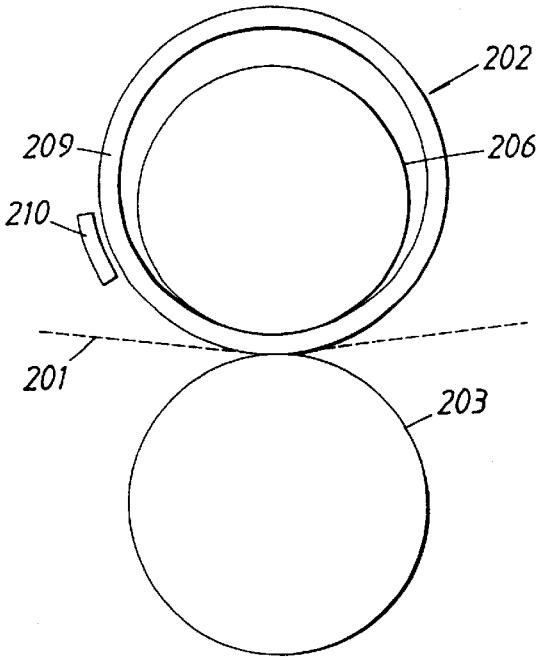
FIG. 12 is an end view of a roll calendar according to the invention.

FIG. 12 schematically shows parts of a roll calendar included in the treatment section of a machine in which a continuous web 201, e.g. a paper or board web, is subjected to a form and/or surface changing mechanical treatment in one or more nips. The web may be coated or uncoated. In the last-mentioned case the machine may be included as a part of a paper machine, for instance, upstream of the reel-up. The roll calendar comprises a first or upper rotatably journalled roll 202 and a second or lower rotatably journalled roll 203, said rolls defining a roll nip with each other. The upper roll 202 comprises a stable cylindrical body 206 having shaft journals (not shown) for rotary journalling of the upper roll 202 in bearing housings. As for the rest, the cylindrical body 206 is arranged and designed in the same way as described above in connection with the shoe press. The roll calendar has a movable sleeve-formed heat transfer means 209 and a heat source 210 which are arranged and designed in the same way as described above in connection with the shoe press.

Figure 13:
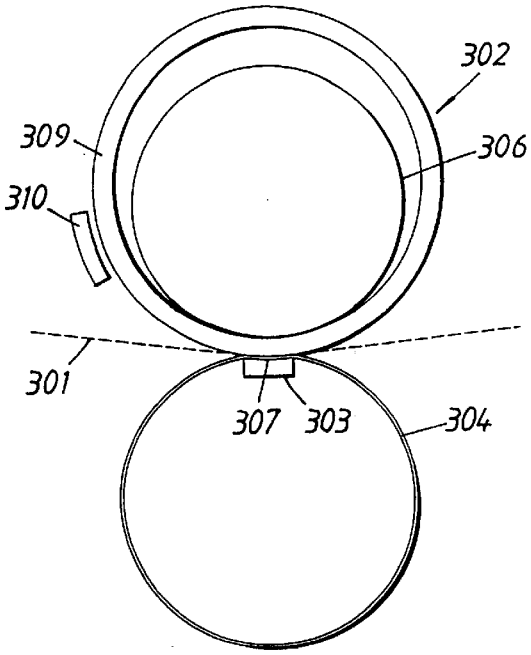
FIG. 13 is an end view of a shoe calendar according to the invention.

FIG. 13 schematically shows parts of a shoe calendar with an extended nip included in the treatment section of a machine in which a continuous web 301, for example a paper or board web, is subjected to a form and/or surface changing mechanical treatment in one or more nips. The web may be coated or uncoated. In the last-mentioned case the machine may be included as a part of a paper machine, for instance, upstream of the reel-up. The shoe calendar comprises a rotatably journalled counter roll 302, a shoe 303 and an impermeable, flexible belt 304. The counter roll 302 comprises a stable cylindrical body 306 having shaft journals (not shown) for rotary journalling of the counter roll 302 in bearing housings. As for the rest, the cylindrical body 306 is arranged and designed in the same way as described above in connection with the shoe press. The shoe 303 has a concave surface 307 for cooperation with the corresponding convex body 306 of the counter roll 302 in order to obtain the extended nip. The flexible belt 304 runs through the nip in sliding contact with the concave surface 307 of the shoe. In the embodiment shown the shoe calendar is provided with a roll including said shoe 303 and belt 304 which is rigidly mounted at rotatable peripheral end portions (not shown). Alternatively, the flexible belt may run in a loop around a plurality of rolls, in which loop the shoe is thus mounted. Further, the shoe calendar has a movable sleeve-formed heat transfer means 309 and a heat source 310 which are arranged and designed in the same way as described above in connection with the shoe press.

The web-contacting elements 203, 209 and 304, 309 and their surfaces of the roll calendar and shoe calendar are constructed and designed in accordance with the basic conceptions described above in connection with the shoe press and simultaneously taking into consideration each specific type of calendaring that is to be carried out under supply of heat for each specific continuous web running through the nip, said considerations being well known for the expert in the technique of calendering, e.g. those being the basis of shoe calendars of the type OptiDwell™ which is sold by Valmet Corporation, Finland.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A pressing device for treating a continuous web of fibrous material, comprising:

a press shoe having a concave surface;

a generally cylindrical press body that rotates about a central longitudinal axis thereof, and a generally tubular sleeve that surrounds the press body and is rotatably driven to rotate therewith, the press body and the press shoe being arranged in opposing relation so as to form an extended nip therebetween through which the sleeve passes along with the web such that the web is pressed between the sleeve and the press shoe, the sleeve being movably connected to the press body such that the sleeve is free to expand in all directions relative to the press body;

an endless impermeable belt arranged to travel through the nip in sliding engagement with the concave surface of the press shoe;

an endless press clothing arranged to travel through the nip such that the web is disposed between the clothing and the impermeable belt; and a heat source arranged to continuously heat the sleeve such that heat is transferred from the sleeve to the web.

2. The pressing device of claim 1, wherein the sleeve is rigid and form-stable.

3. The pressing device of claim 1, wherein the sleeve is flexible relative to the press body.

4. The pressing device of claim 1, wherein the sleeve has a wall thickness that varies in a predetermined manner along a lengthwise direction of the sleeve.

5. The pressing device of claim 1, wherein the press body has an outer surface that is cambered and the sleeve has an inner surface that is cambered so as to be generally parallel to the outer surface of the press body.

6. The pressing device of claim 1, wherein the sleeve has an inner surface defining a plurality of circumferential grooves therein for reducing a surface area of the sleeve that contacts the press body so as to reduce heat transfer from the sleeve to the press body.

7. The pressing device of claim 1, wherein the sleeve is driven to rotate by the press body through frictional contact between an outer surface of the press body and an inner surface of the sleeve.

8. The pressing device of claim 1, wherein an inner surface of the sleeve and an outer surface of the press body have cooperating elements arranged to meshingly engage each other in the vicinity of the nip such that the sleeve is driven to rotate with the press body.

9. The pressing device of claim 1, wherein the sleeve is comprised of two or more layers of different materials.

10. The pressing device of claim 9, wherein the sleeve includes at least a first layer and a second layer defining an outer surface of the sleeve.

11. The pressing device of claim 10, wherein the second layer of the sleeve comprises a material facilitating thermal conduction between the sleeve and the web.

12. The pressing device of claim 10, wherein the second layer of the sleeve comprises a wear-resistant material.

13. The pressing device of claim 10, wherein the second layer of the sleeve comprises a corrosion-resistant material.

14. The pressing device of claim 10, wherein one of the layers comprises a form-stable layer.

15. The pressing device of claim 1, wherein at least one of an outer surface of the press body and an inner surface of the sleeve is formed by a thermally insulating material.

16. A press section in a machine for manufacturing a continuous web of fibrous material, the press section comprising a pair of pressing devices as defined in claim 1, a first of the pressing devices being arranged such that the sleeve of the first pressing device contacts one side of the web, and a second of the pressing devices being arranged such that the sleeve of the second pressing device contacts the other side of the web.

17. A pressing device for treating a continuous web of fibrous material, comprising:

a first press member having a rotating component defining a rotating surface for exerting pressure on the web;

a second press member comprising a generally cylindrical press body that rotates about a central longitudinal axis thereof, and a generally tubular sleeve that surrounds the press body and is rotatably driven to rotate therewith, the press body urging the sleeve against the first press member so as to form a nip between the rotating component of the first press member and the sleeve, the web being passed through the nip, the sleeve being movably connected to the press body such that the sleeve is free to expand in all directions relative to the press body; and a heat source arranged to continuously heat the sleeve such that heat is transferred from the sleeve to the web;

wherein the press body includes tooth elements about a circumference of the press body and projecting outwardly therefrom, and the sleeve defines slots distributed about a circumference of the sleeve, the tooth elements engaging the slots for rotatably driving the sleeve.

18. A pressing device for treating a continuous web of fibrous material, comprising:

a first press member having a rotating component defining a rotating surface for exerting pressure on the web;

a second press member comprising a generally cylindrical press body that rotates about a central longitudinal axis thereof, and a generally tubular sleeve that surrounds the press body and is rotatably driven to rotate therewith, the press body urging the sleeve against the first press member so as to form a nip between the rotating component of the first press member and the sleeve, the web being passed through the nip, the sleeve being movably connected to the press body such that the sleeve is free to expand in all directions relative to the press body; and a heat source arranged to continuously heat the sleeve such that heat is transferred from the sleeve to the web;

wherein the second press member includes at least one stop element arranged on at least one end of the second press member for restraining movement of one end of the sleeve in an axial direction while allowing free axial expansion of the sleeve upon heating of the sleeve.

* * * * *

UNITED STATES PATENT AND TRADEMARK OFFICE

CERTIFICATE OF CORRECTION

PATENT NO. : 6,309,512, B1
DATED : October 30, 2001
INVENTOR(S) : Bengtsson et al.

It is certified that error appears in the above-identified patent and that said Letters Patent is hereby corrected as shown below:

Title page,
Insert the following:
-- Related U.S. Application Data
[60] Provisional application No. 60/106,127, filed Oct. 29, 1998. --.

Signed and Sealed this

Sixth Day of August, 2002

*Attest:*

*Attesting Officer*

JAMES E. ROGAN
*Director of the United States Patent and Trademark Office*